US005409292A

United States Patent [19]

Kain et al.

[11] Patent Number: 5,409,292

[45] Date of Patent: * Apr. 25, 1995

[54] HANDLE FOR INFANT CAR SEAT

[75] Inventors: James M. Kain, Tipp City; John V. Mariol, Cincinnati, both of Ohio

[73] Assignee: Lisco, Inc., Tampa, Fla.

[ * ] Notice: The portion of the term of this patent subsequent to Jun. 28, 2011 has been disclaimed.

[21] Appl. No.: 255,039

[22] Filed: Jun. 7, 1994

Related U.S. Application Data

[63] Continuation-in-part of Ser. No. 106,159, Aug. 13, 1993, Pat. No. 5,324,094.

[51] Int. Cl.[6] ..... A47D 13/02

[52] U.S. Cl. ..... 297/183.1; 297/377; 297/183.3; 16/110 R

[58] Field of Search ..... 297/183, 377; 16/110 R

[56] References Cited

U.S. PATENT DOCUMENTS

| | | | |
|---|---|---|---|
| 1,512,053 | 10/1924 | Ridlinghafer . | |
| 3,096,917 | 7/1963 | Gudiksen | 224/6 |
| 3,575,455 | 4/1971 | Bloch | 294/16 |
| 4,207,997 | 6/1980 | Croyle | 224/55 |
| 5,143,419 | 9/1992 | Tepper et al. | 297/183 |
| 5,207,476 | 5/1993 | Payne | 297/183 |

*Primary Examiner*—Peter R. Brown

*Attorney, Agent, or Firm*—Donald R. Bahr; John E. Benoit

[57] ABSTRACT

An infant carrier comprising a seat having a front, back, opposed parallel side walls, and a handle having opposed parallel legs with one end of each of the legs being pivotally connected to a mating side wall. The legs extend upwardly and inwardly from the side walls and terminate at their distal ends in a spaced apart relationship along a longitudinal axis between the side walls. A handgrip connects the distal ends of the legs so that the transverse axis of the handgrip extends along the longitudinal axis between the side walls. The handle is preferably of a molded plastic and may comprise two substantially identical legs which are secured together in the handgrip area.

8 Claims, 2 Drawing Sheets

HANDLE FOR INFANT CAR SEAT

This is a continuation-in-part of application Ser. No. 08/106,159 filed on Aug. 13, 1993, now U.S. Pat. No. 5,324,094.

The present invention relates generally to infant carriers and more specifically to a handle which is used in conjunction with an infant carrier or car seat.

Many infant seats are available today and usually comprise basically a molded shell with a back, a front, and sides. In order to transport these shells with or without the infant a handle is usually attached thereto, with the handle being pivoted on either side to the shell and often even of a size to be rotated beyond the ends of the shell. A handle normally comprises two upstanding legs pivoted to either side of the shell at the walls and terminating in a crosspiece so that basically a U-shaped handle is provided.

One of the problems of the U-shaped handle is that it forces the palm of the hand grasping the crosspiece of the handle to face in either a forward or a rearward position. This position is not a basically natural position for carrying any piece of equipment. As is well known, the handle on a standard suitcase is aligned in a longitudinal direction so that when the handle is grasped the palm of the hand is facing towards the person carrying the suitcase. This is a more natural way to use the structure of the arm and the muscles so as to reduce fatigue.

U.S. Pat. No. 5,207,496 issued May 4, 1993, proposes a particular handle which is constructed so that the gripping part of the handle is substantially parallel to the longitudinal axis of the infant carrier whereby the palm of the hand of the carrier is facing towards the carrier itself. The handle is constructed by having the legs terminate upwardly in a bifurcated portion with opposite parts of the bifurcation being connected by rods and the ultimate handle being secured transversely between these rods.

It is an object of the present invention to provide a means for transporting an infant carrier whereby the palm of the hand is facing inwardly towards the carrier and whereby the handle itself is of a simplified construction having a specific Z-type configuration.

A further object of the present invention is to provide a handle having a Z-type configuration which is comprised of two separate parts joined together at the handgrip.

This and other objects of the invention will become obvious from the following description taken together with the drawings.

BRIEF DESCRIPTION OF THE INVENTION

The present invention provides an infant carrier which comprises a seat having a front, back, opposed parallel side walls, and a handle having opposed parallel legs with one end of each of the legs being pivotally connected to a mating side wall. The legs extend upwardly and inwardly from the side walls and terminate at their distal ends in a spaced apart relationship along a longitudinal axis between the side walls. A handgrip connects the two distal ends of the legs so that the axis of the handgrip extends along the longitudinal axis between the side walls. The handle may comprise two substantially identical components which are secured together.

DETAILED DESCRIPTION OF THE PREFERRED EMBODIMENT

Figure 1:
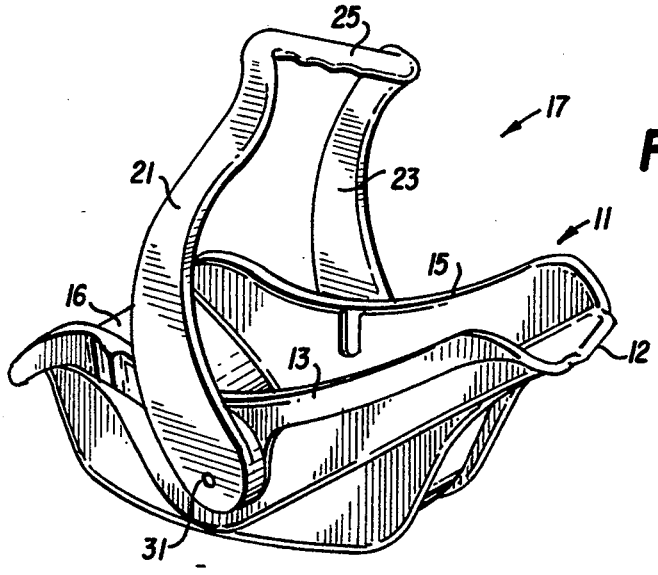
FIG. 1 is a perspective view of the handle of the present invention used with a standard carrier.
Figure 2:
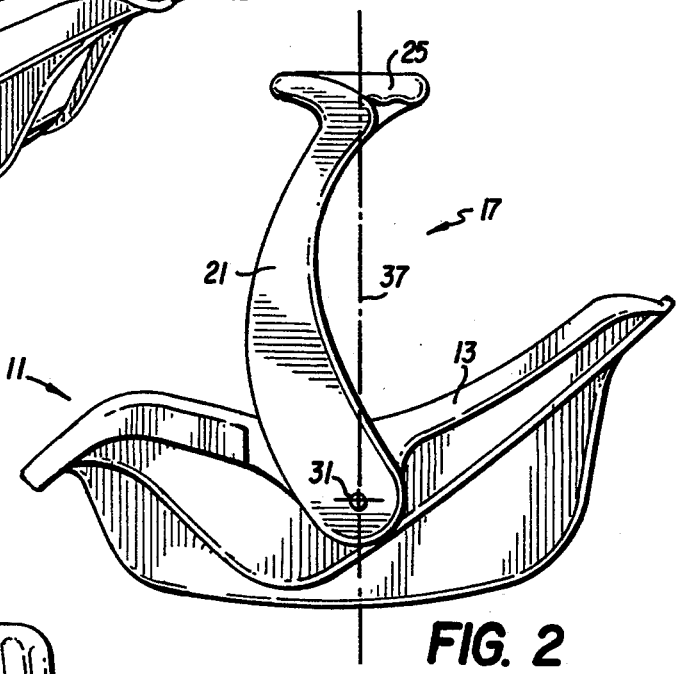
FIG. 2 is a side view of FIG. 1.
Figure 3:
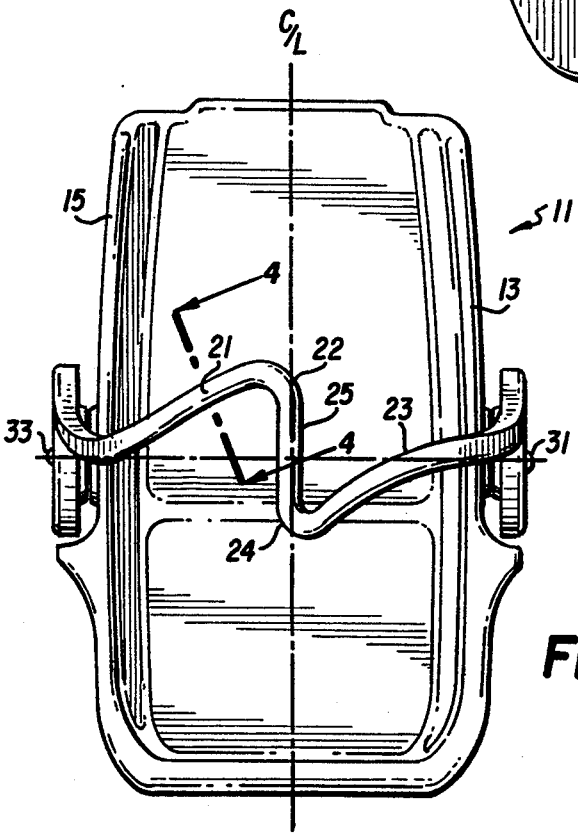
FIG. 3 is a top view of FIG. 1.

Turning now to FIGS. 1, 2, and 3, there is illustrated a standard infant carrier 11 which is normally constructed of a molded shell having a back 12, substantially parallel side walls 13 and 15, and seat 16.

Handle 17 comprises two legs 21 and 23 which are connected to carrier 11 at pivot points 31 and 33. Legs 21 and 23 extend upwardly and inwardly from their respective side walls and terminate at distal ends 22 and 24 (FIG. 3), which lie substantially along a longitudinal axis separating side walls 13 and 15. As shown, this longitudinal axis substantially coincides with the centerline C/L of carrier 11. Preferably the legs have an arcuate configuration as shown in the drawings.

Distal ends 22 and 24 of legs 21 and 23 are connected by means of handgrip 25. Since the handgrip connects the two distal ends, the axis of the handgrip also substantially coincides with the longitudinal axis of the centerline C/L between the two side walls.

With this handle configuration the upper part of legs 21 and 23 and handgrip 25 provides a Z-configuration with the central leg of the "Z" comprising the handgrip.

As will be obvious, when the carrier is supported by the handle and the handgrip is grasped by the user, the palm of his hand will be facing inwardly so as to provide the most comfortable and practical position for transporting the carrier.

As shown in FIG. 2, the ultimate position of the center of the handle will be substantially in vertical alignment with pivot points 31 and 33, allowing good distribution of the weight of the infant in the carrier.

Figure 4:
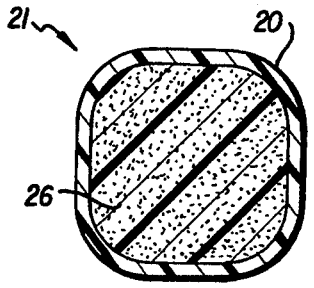
FIG. 4 is a cross-sectional view taken through lines 4—4 of FIG. 3.
Figure 5:
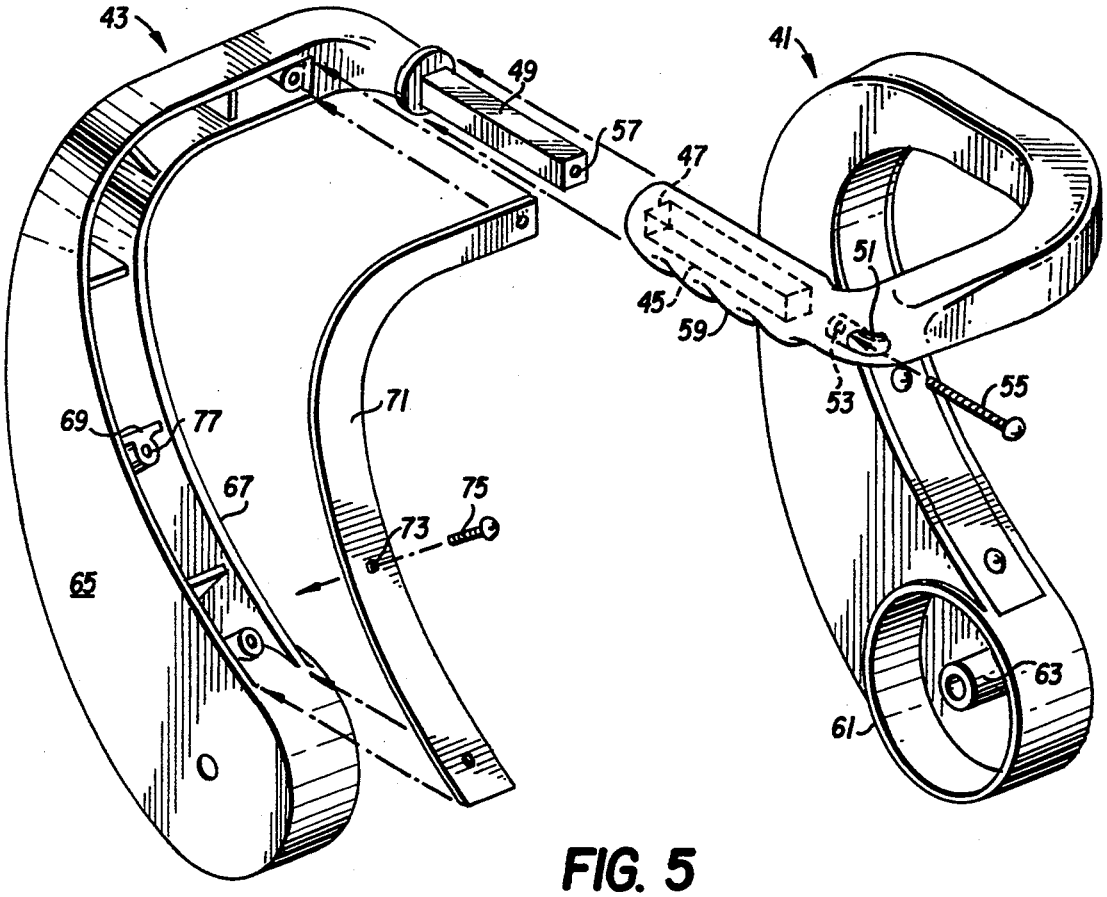
FIG. 5 is a perspective view of a modification of the handle illustrated in FIGS. 1–3.

The handle shown in FIGS. 1–3 is a single unitary unit and is preferably made by blow-molding dense polymeric foam. Referring to FIG. 4, which is a cross-sectional view taken through lines 4—4 of FIG. 3, it can be seen that the process forms a skin 20 which is non-porous and an interior which is filled with a very dense polymeric foam 26. While this produces a very acceptable handle, it is a relatively expensive procedure requiring a rather complicated mold.

In order to reduce the expense of manufacturing the handle, a modified version is shown in FIG. 4. In this figure the handle is split into two substantially identical sections comprising legs 41 and 43. The legs terminate at their distal ends and are configured so as to provide a mating section which occurs essentially at the handgrip section of the handle.

Leg 41 terminates at its distal end in female connector 45 having a rectangular opening 47. Leg 43 terminates in a male connector 49 having a rectangular geometric configuration and being of a size to fit within rectangular opening 47. After the two terminal ends are joined, screw 55 is passed through orifice 43 which exists within slot 51 of leg 41. The screw is secured within internally-threaded borehole 57 so as to firmly connect the two legs. As in most handles, handgrip cover 59 is provided over the handgrip area created by the mating male and female sections.

In order to provide the necessary pivot, the end opposite the distal end of the handles includes circular well 61 having boss 63 therein. The circular well mates with an extended area molded into the seat itself (not shown) and a pin passes through boss 63 so as to provide the necessary pivotal action.

While the individual legs also may be molded in a solid piece, the preferred construction is illustrated in relationship to leg 43. In this modification hollow shell 65 is provided having three sides and internal structurally strengthening ribs 69. This leaves an open area which is then covered by means of separate mating plate 71. Plate 71 may then be secured over opening 67 by means of screws 75 or the like which are secured to boreholes in the rib structure. This construction obviously simplifies the molding process as well as reduces the material which is necessary while still maintaining a structurally sufficient handle.

As will now be obvious, the present invention provides a handle for a carrier which is of simplified construction and which permits transporting the carrier with the hand in a natural position as it normally hangs alongside the body.

Although various materials could be used, it is preferable that the handle, including the legs and the handgrip, be molded as a single unitary piece and that it be removably secured to the carrier shell at the pivot points.

The above description and drawings are illustrative only and variations of the preferred embodiment may be made without departing from the invention, the scope of which is to be limited only by the following claims.

I claim:

1. Apparatus for holding and carrying an infant comprising a carrier having a back, a front, and substantially parallel side walls;

a handle comprising first and second substantially parallel opposed legs;

means at one end of each of said legs for pivotally securing said legs to said side walls;

each of said legs extending upwardly and inwardly from said side walls, the distal ends of said legs terminating in a spaced apart relationship along a longitudinal axis between said side walls; and a handgrip interconnecting said distal ends of said legs wherein the upper sections of said legs and said handgrip form a substantially Z-configuration with the handgrip comprising the central leg of said Z-configuration;

said carrier being a unitary molded shell.

2. The apparatus of claim 1 wherein said handgrip lies substantially transverse to a vertical plane through said pivot points on said side walls.

3. The apparatus of claim 1 wherein said handle is a unitary structure.

4. The apparatus of claim 3 wherein said unitary structure is of a molded dense polymeric foam.

5. The apparatus of claim 1 wherein said handle comprises first and second substantially identical legs which mate at their distal ends to form said handgrip.

6. The apparatus of claim 5 wherein said handgrip comprises a female connector at the distal end of said first leg;

a male connector at the end of said second leg; and a screw for securing said male connector within said female connector.

7. The apparatus of claim 6 wherein each of said legs are of a molded polypropylene.

8. Apparatus for holding and carrying an infant comprising a carrier having a back, a front, and substantially parallel side walls;

a handle comprising first and second substantially parallel opposed legs;

means at one end of each of said legs for pivotally securing said legs to said side walls; and each of said legs extending upwardly and inwardly from said side walls, the distal ends of said legs terminating in an interconnecting handgrip;

said handgrip and the upper sections of said legs forming a substantially Z-configuration with the handgrip comprising the central leg of said Z-configuration.

* * * * *